US009820533B2

(12) United States Patent
Partin et al.

(10) Patent No.: US 9,820,533 B2
(45) Date of Patent: Nov. 21, 2017

(54) REMOVABLE DECORATIVE COVER FOR AN ELEVATED HEEL SHOE

(71) Applicants: Erin Partin, Mason, OH (US); Adam L. Ross, Mason, OH (US); Kelly Ulreich, Villa Hills, KY (US)

(72) Inventors: Erin Partin, Mason, OH (US); Adam L. Ross, Mason, OH (US); Kelly Ulreich, Villa Hills, KY (US)

( * ) Notice: Subject to any disclaimer, the term of this patent is extended or adjusted under 35 U.S.C. 154(b) by 0 days.

(21) Appl. No.: 14/991,049

(22) Filed: Jan. 8, 2016

(65) Prior Publication Data

US 2016/0198799 A1 Jul. 14, 2016

Related U.S. Application Data

(60) Provisional application No. 62/101,077, filed on Jan. 8, 2015.

(51) Int. Cl.

| | |
|---|---|
| ***A43B 23/24*** | (2006.01) |
| ***A43B 3/16*** | (2006.01) |
| ***A43B 3/24*** | (2006.01) |

(52) U.S. Cl.

CPC ..... *A43B 23/24* (2013.01); *A43B 3/16* (2013.01); *A43B 3/242* (2013.01)

(58) Field of Classification Search

CPC ..... A43B 23/24; A43B 3/16; A43B 3/242

See application file for complete search history.

(56) References Cited

U.S. PATENT DOCUMENTS

| | | | | |
|---|---|---|---|---|
| 2011/0078919 | A1* | 4/2011 | Yang | A43B 3/20 36/1.5 |
| 2014/0020267 | A1* | 1/2014 | Perez | A43C 15/00 36/59 R |
| 2014/0115927 | A1* | 5/2014 | Lucas | A43B 23/24 36/109 |
| 2014/0182168 | A1* | 7/2014 | Avar | A43B 3/242 36/100 |
| 2015/0000165 | A1* | 1/2015 | Reiff | A43B 13/22 36/72 R |

(Continued)

*Primary Examiner* — Shaun R Hurley
*Assistant Examiner* — Andrew W Sutton
(74) *Attorney, Agent, or Firm* — Baker & Hostetler LLP

(57) ABSTRACT

A removable decorative cover for a shoe includes a pair of longitudinal side panels adapted to cover opposed side walls of an elevated heel shoe, each side panel respectively having a heel portion extending to a toe portion; a lateral upper toe panel connecting the toe portions of each of the side panels, the lateral upper toe panel adapted to cover an upper wall of the elevated shoe approximate the toe portion of the shoe; a lateral front band connecting to connecting the toe portions of each of the side panels, the lateral front band adapted to extend around the front of the toe portion of the shoe, the lateral front band and lateral upper toe panel providing an open-toe opening therebetween; a closure mechanism carried on the heel portion of each of the longitudinal side panels and adapted to allow each of the heel portions to be engaged and releasably connected by the closure mechanisms along a vertical back wall of the shoe; and a lateral lower panel connecting each of the side panels between the heel portions and the toe portions and adapted to extend below an elevated portion of the shoe between the heel and the toe of the shoe.

9 Claims, 5 Drawing Sheets

(56) References Cited

U.S. PATENT DOCUMENTS

| | | | | |
|---|---|---|---|---|
| 2015/0265003 | A1* | 9/2015 | Lauria | A43B 1/0027 2/245 |
| 2015/0342262 | A1* | 12/2015 | Meinecke | A41F 13/00 2/240 |
| 2016/0106178 | A1* | 4/2016 | Monger | A43B 3/16 36/7.1 R |
| 2016/0198799 | A1* | 7/2016 | Partin | A43B 23/24 2/245 |

* cited by examiner

REMOVABLE DECORATIVE COVER FOR AN ELEVATED HEEL SHOE

CROSS REFERENCE TO RELATED APPLICATIONS

The current application claims priority to U.S. Provisional Application Ser. No. 62/101,077, filed Jan. 8, 2015, the disclosure of which is incorporated herein by reference.

BACKGROUND

A main concern when traveling is being able to properly fit everything you need into a single small suitcase. Often times multiple pairs of shoes may be needed for a trip, however, shoes can be quite bulky and do not fit nicely into a suitcase or bag. Almost all shoes consist of the same basic components: a sole, a heel, and an upper, comprising a covering for the top, side, and back of the foot. The present disclosure details a shoe with a removable decorative covering to produce multiple looks from one base pair of shoes, solving the problem of trying to pack numerous pairs of bulky shoes by achieving multiple looks through one base pair of shoes and many corresponding "Coverlette" removable decorative coverings.

Unlike other shoes with removable decorations that currently exist on the market, the present invention does more than merely adding a decorative element, such as a bedazzled pin, large sticker, or changing the very front "vamp" portion of the shoe, but instead creates an entirely new pair of shoes by covering the existing shoe upper with a new design. While there have been disclosures of shoes containing a decorative covering, they attach using adhesive means, such as tape or Velcro. These devices are difficult to remove and the imperfect fit creates undesired bulking and pleating. These devices typically target younger audiences such as children who want to add decorative elements to their shoes to express their individuality. The present invention targets a much more sophisticated buyer who is looking for a fashion-forward and budget-friendly alternative to owning numerous pairs of designer shoes. The "Coverlette" removable decorative covering contains a zippered closure means that creates a dramatic statement—transforming a boring, basic pair of shoes into numerous chic, high-fashion shoes.

Other inventions presently known in the art require that the decorative shoe cover attach to the shoe via stitching, glue, adhesive means, Velcro, or zippered means. This creates an unseemly appearance in the shoe by requiring altering the shoes and adding places for the attachment of the decorative covering. The coverings cannot be used in all types of shoes, but only those that can be adapted to use the attaching means. Many users would not want to use a decorative covering currently existing on the market on a pair of expensive designer shoes for fear that the addition of the attachments would ruin the underlying pair of shoes, rendering them unable to worn without a decorative covering.

SUMMARY

The present invention allows the user to own one base pair of shoes and to utilize numerous "Coverlette" removable decorative coverings to create entirely new looks from a single pair of shoes. This not only creates ease in traveling, as the coverings are light weight, flexible, and easy to pack, but also creates a budget-friendly alternative to owning numerous pair of high quality shoes. Instead of merely adding a few new decorative elements to the existing shoe design, the "Coverlette" removable decorative coverings can completely alter the look of the existing shoe to create what appears to be a brand new pair of shoes. The existing pair of shoes remains unchanged and unharmed, as the present invention does not require the use of adhesives, stitching, Velcro, or zippers in attaching the removable decorative covering to the shoe. The "Coverlette" removable decorative covering does not require adhesion to the shoes, but rather attaches only to itself through a zippered means (or other suitable closure) located in the rear of the shoe and through an optional wrap located on the bottom sole of the shoe.

Unlike anything presently on the market, the "Coverlette" removable decorative covering allows for a pair of shoes to be easily and rapidly changed into a new design without sacrificing the integrity of the underlying shoe. The "Coverlette" removable decorative covering only attaches to itself, leaving the pair of shoes in mint condition when the removable decorative covering is removed. Not only can the user readily change and reuse removable decorative coverings, the user can also still enjoy the original pair of shoes without the coverings—particularly desirable for expensive or designer shoes. The "Coverlette" removable decorative covering allows for fashion-forward users to easily transform their shoes using these light-weight, flexible, removable decorative coverings that can constantly be changed, reused, or washed, and easily fit in a small purse or bag.

This disclosure is generally drawn to the fashion industry, particularly to shoes. More specifically, this disclosure relates to shoes with a removable decorative covering. While various aspects and embodiments are disclosed herein, other aspects and embodiments will be apparent to those skilled in the art. The various aspects and embodiments disclosed herein are for purposes of illustration and are not intended to be limiting.

The "Coverlette" removable decorative covering comprises a semi-flexible decorative covering corresponding to the shape of a shoe that may be made out of nearly any material, including but not limited to: real or artificial leather, cotton, elastic, polyester, nylon, silk, cashmere, wool, rayon, acetate, acrylic, spandex, polyurethane, polypropylene, olefin, canvas, satin, suede, combinations thereof, or similar materials. More preferable the removable decorative covering could consist of real or artificial leather, cotton, nylon, spandex, suede, satin, or canvas or combinations thereof. Most preferably the removable decorative covering could consist of real or artificial leather.

The "Coverlette" removable decorative covering contains a zippered means located near the rear of the shoe for removably attaching the decorative covering to the shoe. The zippered means could be a contrasting color to the removable decorative covering, such as a black removable decorative covering and red, white, silver, or gold zippered means, or could be a similar color to the removable decorative covering, such as a black removable decorative covering and a black zippered means.

The "Coverlette" removable decorative covering may optionally wrap around the bottom sole of the shoe to secure the covering to the shoe and prevent undesired bunching or pleating. The removable decorative covering may attach to itself when wrapping around the bottom sole of the shoe via any attachment means, including but not limited to adhesive means, glue, stitching, Velcro, hooks, zippered means, other similar devices, and combinations thereof.

The "Coverlette" comprises a pair of longitudinal side panels adapted to cover opposed side walls of an elevated heel shoe, each side panel respectively having a heel portion extending to a toe portion; a lateral upper toe panel connecting the toe portions of each of the side panels, the lateral upper toe panel adapted to cover an upper wall of the elevated shoe approximate the toe portion of the shoe; a lateral front band connecting to connecting the toe portions of each of the side panels, the lateral front band adapted to extend around the front of the toe portion of the shoe, the lateral front band and lateral upper toe panel providing an open-toe opening therebetween; a closure mechanism carried on the heel portion of each of the longitudinal side panels and adapted to allow each of the heel portions to be engaged and releasably connected by the closure mechanisms along a vertical back wall of the shoe; and a lateral lower panel connecting each of the side panels between the heel portions and the toe portions and adapted to extend below an elevated portion of the shoe between the heel and the toe of the shoe wherein said closure mechanism is a zipper mechanism.

The "Coverlette" is comprised of two longitudinal side panels covering the "Coverlette" shoe from heel to the toe area, connected by a lateral upper toe panel and lateral front band extending around the front toe portion of the shoe, and secured through a closure mechanism located on the heel portion of the "Coverlette" shoe, consisting of a zippered means. The lateral front band extends around the front toe portion of the shoe, and can, in one embodiment of the invention, provide an open-toe opening between the lateral front band and lateral upper toe panel. The closure mechanism is located on the back of the shoe in the heel portion and is adapted to releasably connect the sides, top, and lower panel portions of the shoe.

One embodiment of the "Coverlette" may include the lateral upper toe panel having a cut extending longitudinally therein to prevent bunching on the decorative cover. This cut is engineered to ensure the cover does not bunch or pleat in an undesirable fashion. The cut may vary in length depending on the fit and type of shoe desired. The cut length could be mere millimeters in length, centimeters in length, or a few inches in length depending on the shoe and the fit desired.

The "Coverlette" removable decorative covering may consist of any color, design, or pattern. The removable decorative covering may contain other decorative elements, including but not limited to desired bunching, pleating, openings such as holes or exposed portions; decorative fabric elements such as ruffles, ruching, gatherings, pleating, or similar elements; and decorative hardware elements such as buttons, pearls, zippers, sequins, glitter, rhinestones, jewels, pins, similar elements, or combinations thereof.

The "Coverlette" shoe having a removable decorative cover for an elevated heel shoe comprises a sole, a heel, and an upper portion with a rim defining a foot opening, including but not limited to high-heeled shoes, low-heeled shoes, wedge-heeled shoes, boots, loafers, tennis shoes, and sandals. The "Coverlette" shoe could be a stiletto, pump, kitten heel, open-toe, sling-back, mule, clog, platform, peep-toe, cone heel, ankle strap, T-strap, wedge, ballerina flat, moccasin, boat shoe, jelly shoe, loafer, oxford shoe, tennis shoe, riding boot, cowboy boot, Wellington boot, Ugg boot, or a similar item. More preferably the "Coverlette" shoe comprises a high-heeled or low-heeled shoe, such as a stiletto, pump, kitten heel, open toe, sling-back, wedge-heeled shoe, ballerina flat or loafer. Most preferably the "Coverlette" shoe comprises a stiletto, pump, or platform high-heeled shoe.

BRIEF DESCRIPTION OF THE DRAWINGS

The foregoing and other features of the present disclosure will become more fully apparent from the following description, taken in conjunction with the accompanying drawings. Other embodiments may be utilized and other changes may be made without departing from the spirit and scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and made part of this disclosure.

In the drawings.

DETAILED DESCRIPTION OF THE DRAWINGS

In the following detailed description, reference is made to the accompanying drawings, which form a part hereof. The illustrative embodiments described herein are not meant to be limiting. Other embodiments may be utilized and other changes may be made without departing from the spirit or scope of the subject matter presented. It will be readily understood to someone skilled in the art that the aspects of the present disclosure, as generally described herein and as illustrated in the Figures, may be arranged, substituted, combined, and designed in a wide variety of different configurations, all of which are explicitly contemplated and made part of this disclosure.

FIGS. 1 through 5 depict a shoe 14 having a "Coverlette" removable decorative covering 15. The "Coverlette" shoe is a shoe having a removable decorative covering where the outer appearance of the shoe may be altered by attaching a removable decorative covering 15 to the shoe 14. The "Coverlette" removable decorative covering is a covering for a shoe made of semi-flexible material that can correspond to the shape of a shoe so that when the covering is placed on a shoe the top portion of the shoe is at least partially covered that is secured to the shoe via a zipper (or other suitable closure) located in the back of the covering near the heel of the shoe.

Figure 1:
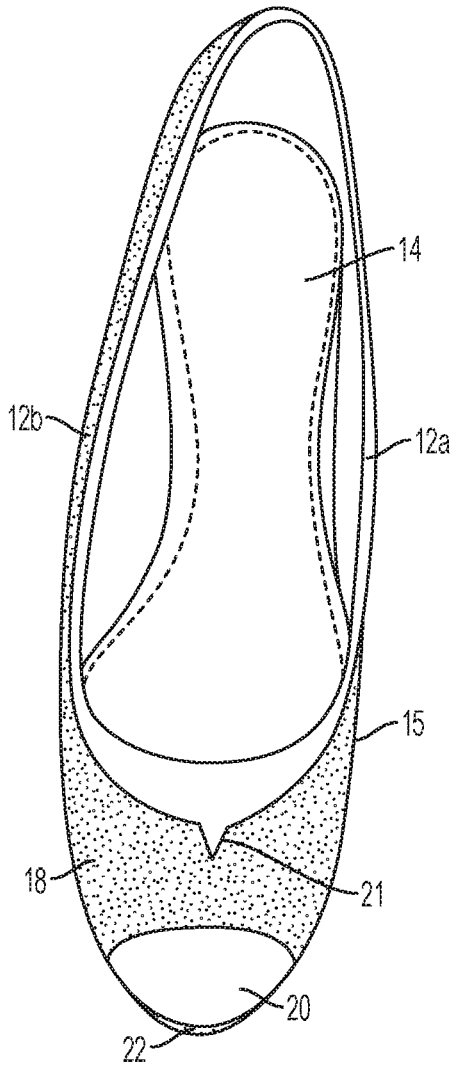
FIG. 1 depicts a top view of an example of a shoe having a removable decorative "Coverlette" covering, showing the lateral upper toe panel, lateral front band, and the optional cut in the in the lateral upper toe panel.

FIG. 1 depicts a top view of a "Coverlette" shoe and removable decorative covering. FIG. 1 shows a lateral upper toe panel 18 connecting the toe portions of each of the side panels 12(*a*) and 12(*b*) with the lateral upper toe panel 18 adapted to cover an upper wall of an elevated shoe 14 approximate the toe portion of the shoe 20. The Figure also shows a lateral front band 22 connecting the toe portions of each of the side panels, with the lateral front band 22 adapted to extend around the front of the toe portion of the shoe 20. The lateral front band 22 and lateral upper toe panel 18 may provide an open-toe opening 20 therebetween, as shown in the Figure. The lateral upper toe panel 18 may also optionally contain a cut 21 extending longitudinally therein to prevent bunching on the decorative cover. The cut 21 may vary in length depending on the shoe 14 used and the fit desired.

Figure 2:
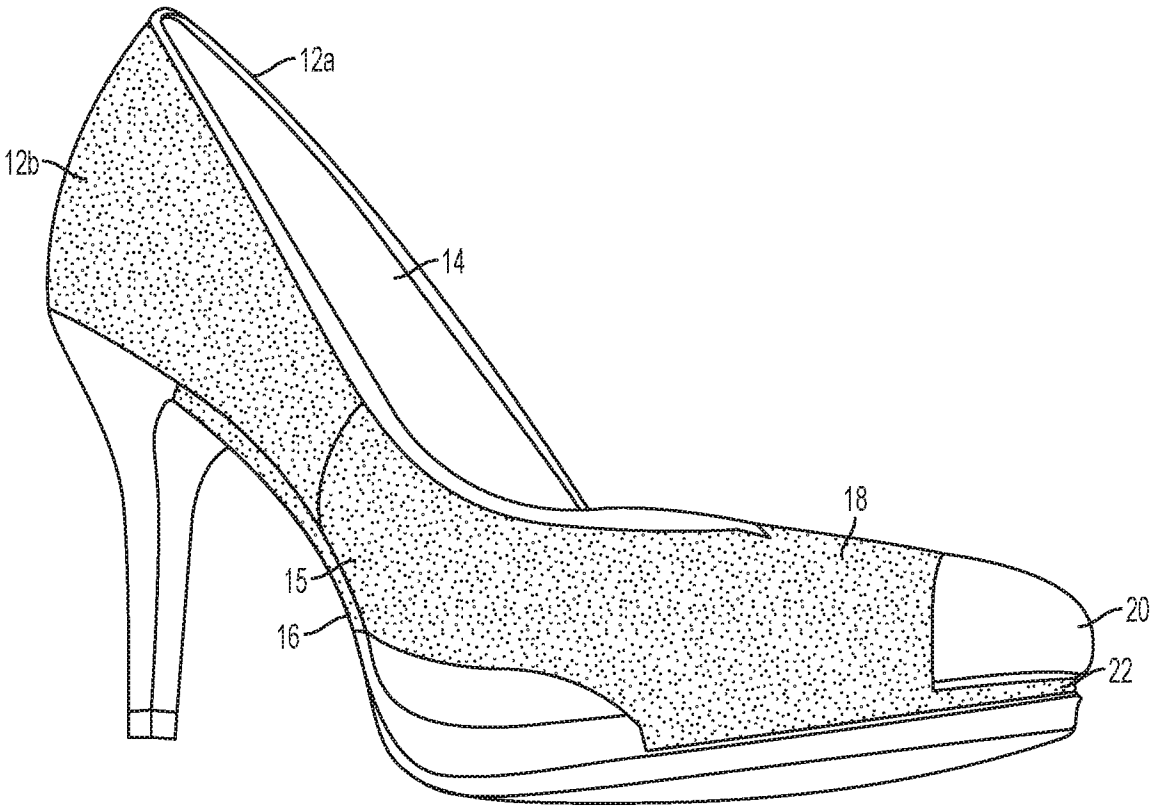
FIG. 2. depicts a side view of an example of a shoe having a removable decorative "Coverlette" covering, showing the longitudinal side panels and the lateral upper toe panel connecting the toe portions of each side panel and the lateral front band connecting the toe portions of each side panel.

FIG. 2. depicts a side view of an example of a shoe 14 having a removable decorative "Coverlette" covering 15. FIG. 2 shows the longitudinal right side panel 12(*b*) and the lateral upper toe panel 18 connecting the toe portions of the right side panel 12(*b*) and the lateral front band 22 connecting the toe portions of the side panel 12(*b*). The Figure shows the longitudinal side panels 12(*a*) and 12(*b*) adapted to cover opposed side walls of the elevated heel shoe 14, with each side panel 12(*a*) and 12(*b*) respectively having a heel portion extending to the toe portion. The Figure also shows a lateral front band 22 connecting the toe portions of the side panel 12(*b*) with the lateral front band 22 adapted to extend around the front toe portion of the shoe 20.

Figure 3:
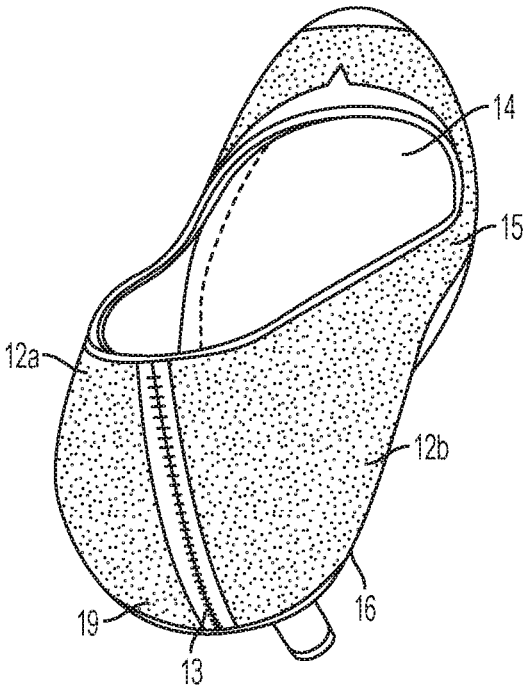
FIG. 3. depicts a back view of an example of a shoe having a removable decorative "Coverlette" covering, showing the closure mechanism on the heel portion connected to each longitudinal side panel and the lateral lower panel connecting each side panels between the heel portions and the toe portions.

FIG. 3 depicts a back view of a "Coverlette" shoe 14 and a removable decorative covering 15. FIG. 3 shows the lateral lower panel 16 connecting to each side panels 12(*a*) and 12(*b*) between the heel portions 19 and the toe portions 20, adapted to extend below an elevated portion of the shoe 14 between the heel 19 and the toe 20 of the shoe. The Figure also shows a closure mechanism 13 carried on the heel portion 19 of each of the longitudinal side panels 12(*a*) and 12(*b*), adapted to allow each of the heel portions 19 to be engaged and releasably connected by the closure mechanisms 13 along the vertical back wall of the shoe.

Figure 4:
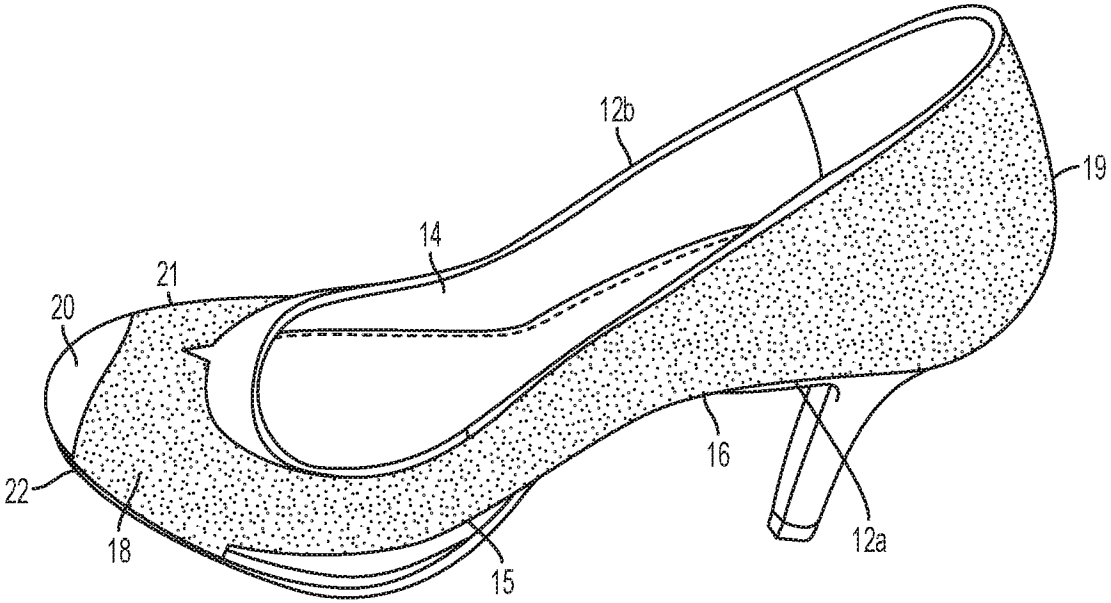
FIG. 4. depicts another side view of an example of a shoe having a removable decorative "Coverlette" covering, showing the longitudinal side panels and the lateral upper toe panel connecting the toe portions of each side panel and the lateral front band connecting the toe portions of each side panel.

FIG. 4 depicts another side view of an example of a shoe 14 having a removable decorative "Coverlette" covering 15. FIG. 4 shows the longitudinal left side panel 12(*a*) and the lateral upper toe panel 18 connecting the toe portions 20 of the right side panel 12(*b*) and the lateral front band 22 connecting the toe portions 20 of the side panel 12(*b*). The longitudinal left side panel 12(*a*) also connects to the heel portion 19 of the shoe 14 through the lateral lower panel 16. The Figure shows the longitudinal side panels 12(*a*) and 12(*b*) adapted to cover opposed side walls of the elevated heel shoe 14, with each side panel 12(*a*) and 12(*b*) respectively having a heel portion 19 extending to the toe portion 20. The Figure also shows a lateral front band 22 connecting the toe portions 20 of the side panel 12(*a*) with the lateral front band 22 adapted to extend around the front toe portion 20 of the shoe 14.

Figure 5:
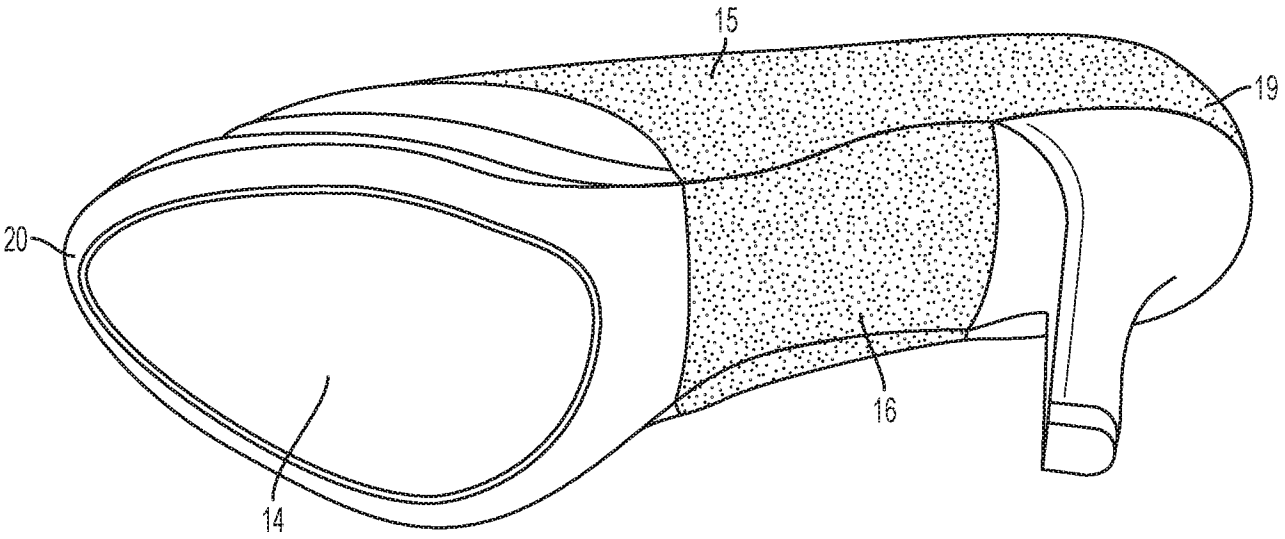
FIG. 5. depicts a bottom view of an example of a shoe having a removable decorative "Coverlette" covering, showing the lateral lower panel connecting each side panels between the heel and toe portions, adapted to extend below an elevated portion of the shoe between the heel and toe of the shoe.

FIG. 5 depicts a bottom view of a "Coverlette" shoe 14 and removable decorative covering 15. FIG. 5 shows the lateral lower panel 16 connecting to each side panels 12(*a*) and 12(*b*) between the heel portions 19 and the toe portions 20, adapted to extend below an elevated portion of the shoe between the heel 19 and the toe 20 of the shoe 14.

Again, the removable decorative covering 15 does not require the use of adhesive, stitching or Velcro on the shoe 14, but is engineered to fit precisely on the shoe using only a zippered means (or other suitable closure) located in the rear of the shoe, along with an optional wrap 16 underneath the bottom sole of the shoe. The "Coverlette" removable decorative covering, in a preferred embodiment, attaches only to itself and does not need to be attached to the shoe, leaving the shoe unchanged and allowing the shoe to be worn without the removable decorative covering, if so desired.

Having described the invention by way of the above description and the attached drawings, it will be apparent to those of ordinary skill in the art that modifications can be made to the inventions disclosed herein without departing from the scope of the invention as claimed in the following claims.

What is claimed is:

1. A removable decorative cover for an elevated heel shoe, comprising:

a pair of longitudinal side panels adapted to substantially cover opposed side walls of an elevated heel shoe, each side panel respectively having a heel portion extending to a toe portion;

a lateral upper toe panel connecting the toe portions of each of the side panels and covering the toe portion of the shoe, the lateral upper toe panel adapted to cover an upper wall of the elevated heel shoe approximate the toe portion of the shoe;

a lateral front band connecting to connecting the toe portions of each of the side panels, the lateral front band adapted to extend around the front of the toe portion of the shoe, the lateral front band and lateral upper toe panel providing an open-toe opening therebetween;

a closure mechanism carried on the heel portion of each of the longitudinal side panels and adapted to allow each of the heel portions to be engaged and releasably connected by the closure mechanisms along a vertical back wall of the shoe; and a lateral lower panel connecting each of the side panels between the heel portions and the toe portions and adapted to extend below an elevated portion of the shoe between the heel and the toe of the shoe;

wherein said closure mechanism is a zipper mechanism.

2. A removable decorative cover for an elevated heel shoe, the shoe including a sole, a heel, and an upper portion comprising a rim defining a foot opening, the removable decorative cover comprising:

a pair of longitudinal side panels adapted to cover opposed side walls of an elevated heel shoe, each side panel respectively having a heel portion extending to a toe portion;

a lateral upper toe panel connecting the toe portions of each of the side panels, the lateral upper toe panel adapted to cover an upper wall of the elevated shoe approximate the toe portion of the shoe;

a lateral front band connecting to connecting the toe portions of each of the side panels, the lateral front band adapted to extend around the front of the toe portion of the shoe, the lateral front band and lateral upper toe panel providing an open-toe opening therebetween;

a closure mechanism carried on the heel portion of each of the longitudinal side panels and adapted to allow each of the heel portions to be engaged and releasably connected by the closure mechanisms along a vertical back wall of the shoe; and a lateral lower panel connecting each of the side panels between the heel portions and the toe portions and adapted to extend below an elevated portion of the shoe between the heel and the toe of the shoe.

3. The removable decorative cover of claim 1, wherein the lateral upper toe panel includes a notch extending partially longitudinally therein to prevent bunching on the decorative cover.

4. The removable decorative cover for an elevated heel shoe of claim 2 wherein said decorative cover contains a notch extending partially longitudinally therein the lateral upper toe panel to prevent undesired bunching or pleating.

5. The removable decorative cover for an elevated heel shoe of claim 2 wherein said decorative cover consists of one of real and artificial leather material.

6. The removable decorative cover for an elevated heel shoe of claim 2 wherein said closure mechanism is a zipper.

7. The shoe having a removable decorative cover for an elevated heel shoe of claim 2 wherein said shoe comprises an elevated sole so as to create a platform heel in which said removable decorative covering may attach to said shoe.

8. The shoe having a removable decorative cover for an elevated heel shoe of claim 2 wherein said shoe is a high-heeled shoe.

9. The shoe having a removable decorative cover for an elevated heel shoe of claim 2 wherein said shoe is a boot.

* * * * *